US009320584B2

(12) United States Patent
Munson

(10) Patent No.: US 9,320,584 B2
(45) Date of Patent: Apr. 26, 2016

(54) FEEDING TUBE INSERTION DEVICE

(71) Applicant: Munson Labs, Colton, WA (US)

(72) Inventor: Roland Munson, Colton, WA (US)

(73) Assignee: Munson Labs, LLC, Portland, OR (US)

( * ) Notice: Subject to any disclaimer, the term of this patent is extended or adjusted under 35 U.S.C. 154(b) by 0 days.

(21) Appl. No.: 14/183,327

(22) Filed: Feb. 18, 2014

(65) Prior Publication Data

US 2015/0231037 A1 Aug. 20, 2015

(51) Int. Cl.
*A61D 7/00* (2006.01)

(52) U.S. Cl.
CPC ..... *A61D 7/00* (2013.01)

(58) Field of Classification Search
CPC ... A61J 15/0026; A61J 15/00; A61J 15/0023; A61J 15/0011; A61J 15/0015; A61B 17/3415; A61D 7/00
USPC ..... 604/115, 116, 910, 79, 80, 159, 183, 604/281, 282, 275, 257–261
See application file for complete search history.

(56) References Cited

U.S. PATENT DOCUMENTS 5,449,346 A * 9/1995 Buffington et al. ..... 604/115
2002/0177838 A1* 11/2002 Germain ..... 604/500

OTHER PUBLICATIONS

STIC Search Report, Dec. 10, 2015.*

* cited by examiner

*Primary Examiner* — Kami A Bosworth
*Assistant Examiner* — Hamza Darb
(74) *Attorney, Agent, or Firm* — Schwabe, Williamson & Wyatt, P.C.

(57) ABSTRACT

A feeding tube placement device comprising a shaft and a functional tip which can be removably attached to a feeding tube, and which is used by insertion into a small animal's mouth then through the wall of the esophagus where a feeding tube is attached and then drawn back into the esophagus and positioned for use in feeding.

5 Claims, 5 Drawing Sheets

FEEDING TUBE INSERTION DEVICE

BACKGROUND OF THE INVENTION

There is a need for innovation solutions in veterinary medical procedures, enabling faster, safer, more efficient surgeries. Herein we propose a novel, assisting device and method for insertion of feeding tubes during veterinary procedures. The described invention includes a device and methods for feeding tube insertion and placement, which lower risk to the animal, reduce time of procedure, and greatly increase the ease of use for the veterinary medical professional administering the procedure.

Current devices and methods for insertion of feeding tubes in small animal esophagostomy procedures are time-intensive, difficult to maneuver, and run the risk of damaging tissue in the animal. These procedures are necessary in cases when an animal cannot or will not eat in the normal manner. Feeding tube insertion may also be necessary to address medical conditions such as inappetance, occurring due to metabolic disorders (such as hepatic lipodosis), or oral tumors and lesions. These procedures are frequently done in veterinary practices, clinics and hospitals.

There are a few devices in existence that are intended to assist in veterinary feeding tube placement procedures, but they are limited in application and carry with them a range of issues. The current devices are limited in the scope of animals that can be treated. For instance, they may only work in large cats and small dogs, and are only reliably effective in larger cats. An array of other issues is associated with the existing devices, from poor usability to safety. When using one of the existing devices, the required size of incision is relatively large and adjacent to the Jugular vein, thus associated with greater risk to the animal, tissue disruption, and recovery time.

In existing procedures, an incision is made on the neck of the animal; the incision is large enough to allow for the manual insertion of the tube from the outside, followed by the veterinarian pushing it down the throat of the animal into the esophagus.

In these cases, the placement of the device is also risky, requiring extreme precision on the part of the physician, as it is extremely close to the jugular vein of the animal. Another drawback of the current solutions is the inability to work effectively when there is a tumor present in the animal's mouth or throat, which is a fairly common scenario in small animal oncology care.

Using the invention proposed herein, the time required to conduct a typical feeding tube placement procedure in small animals is reduced by at least 80%. The resulting clean-up and recovery is also reduced. The associated risk to the animal is practically eliminated using the tools and methods described herein.

SUMMARY OF THE INVENTION

Disclosed herein is a device for assisting with feeding tube insertion in animals, including dogs and cats, said device comprising:

- a handle;
- a functional tip adapted to be releasably attached to a feeding tube; and
- a rigid main body shaft interconnecting said handle and said functional tip wherein said shaft comprises an angled portion between the handle and tip.

Also disclosed herein is a method of insertion of a feeding tube into an esophagus, comprising:

- providing a feeding tube insertion device comprising a handle, a shaft, and a functional tip;
- inserting said functional tip and a portion of said shaft of said feeding tube insertion device into a patient's mouth and down said patient's esophagus;
- creating an incision in said patient's neck and through a wall of said esophagus and pushing said functional tip through said incision and positioning said functional tip outside of said patient's body;
- providing a feeding tube having an attachment end and a feeding end and removably attaching said feeding end of said feeding tube to said functional tip;
- pulling said device and said attached feeding tube back into said esophagus through said incision; and
- removing said feeding tube from said functional tip, and removing said device from said patient.

The foregoing and other objectives, features, and advantages of the invention will be more readily understood upon consideration of the following detailed description of the invention taken in conjunction with the accompanying drawings.

DETAILED DESCRIPTION OF THE INVENTION

Disclosed herein is a placement device and method of use. The placement device is a hand-held tool, which has a handle for gripping by hand on one end, and an oblique end including a functional tip on the other end for attachment to a feeding tube. The functional tip is very narrow, approximately the diameter of a feeding tube, and enabling a press-fit with the feeding tube. In one exemplary use case, the functional tip has a removable cap, which serves to protect the patient's esophageal tissue by sliding smoothly during insertion before the feeding tube is attached. Once the cap is removed, the tip allows for effective attachment to a feeding tube.

In the exemplary use case, once the feeding tube is attached to the tool, the user can use a pulling motion to slide the tube back into the patient's throat. The tool with feeding tube attached is retracted into the esophagus, then detached from the instrument and maneuvered down the esophagus, leaving the feeding tube inserted from outside the cervical neck into the esophagus and ending in the cardiac area.

Figure 1:
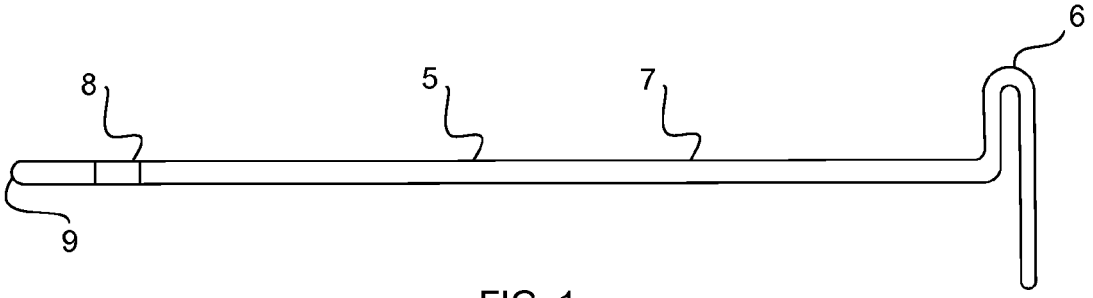
FIG. 1 is a side view of one embodiment of the device in accordance with one embodiment of the invention and devices disclosed herein.
Figure 2:
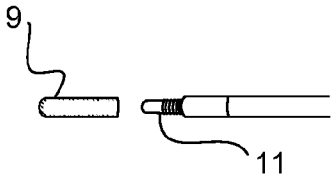
FIG. 2 is an enlarged view of the functional end of one embodiment of the devices disclosed herein with the cap removed.
Figure 2A:
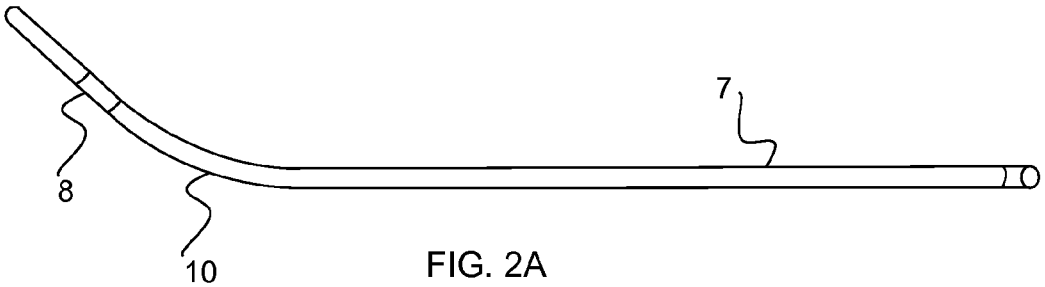
FIG. 2*a* is a view of an additional embodiment of the device in accordance with the method and devices disclosed herein.
Figure 3:
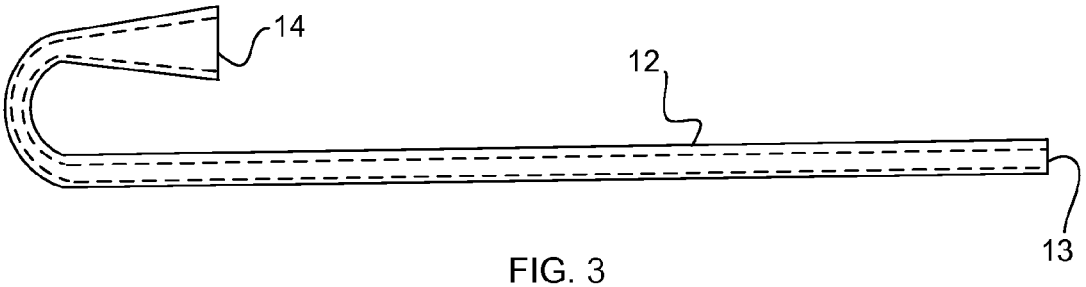
FIG. 3 is a side view of a feeding tube.

Referring now to the drawings, as shown in in FIGS. 1-2, feeding tube placement device 5 has a handle 6 which the user holds onto during the feeding tube insertion procedure. In one embodiment, the handle 6 may be an extension of the shaft 7 and shaped from the same piece of metal that the shaft 7 is made from. In one embodiment it may be a U-shaped bend starting at a 90 degree angle to the shaft 7.

The shaft 7 is the straight portion of the device extending from the handle 6 to the bend 10 portion of the device. In an exemplary embodiment, the shaft extends approximately 8.5 inches from the handle 6 to the bend 10 portion of the device. The range of the shaft 7 length may be from 6 to 12 inches. In a typical embodiment, the shaft 7 is a metal or plastic tube, and may be hollow or solid, with a diameter of 0.1 to 0.4 inches. In an exemplary embodiment, the shaft 7 is a solid metal tube having a diameter of 0.25 inches. It is understood that these measurements may vary without departure from the spirit and scope of this disclosure.

The oblique tip 8 is the end of the device opposite the handle 6, which has a removable cap 9 covering a functional tip 11. The length of the oblique tip is usually 1-2 inches. In a typical embodiment, the oblique tip 8 is the same diameter and material as the shaft 7 and the rest of the device. In one embodiment, the removable cap 9 has internal threading inside one end of the tip allowing it to thread onto a threaded functional tip 11. Another locking mechanism other than threading may be used. The same threading or locking mechanism may be used to attach a feeding tube, as described below. In another embodiment, the removable cap 9 is made of a magnetic material enabling it to be magnetically attached to cover the functional tip 11. In this embodiment, the removable cap 9 can also be magnetically secured to a metal tray or surface used during the procedure to prevent it from being lost. There may be other methods of attaching the removable cap 9 to the functional tip 11.

In one embodiment, the bend 10 portion of the device begins approximately 5.5 inches from the oblique tip 8 end of the device. In one embodiment, the bend 10 curves from the linear shaft 7 at an angle between 30 and 60 degrees. The bend 10 angle may be optimized according to specific applications.

Figure 4:
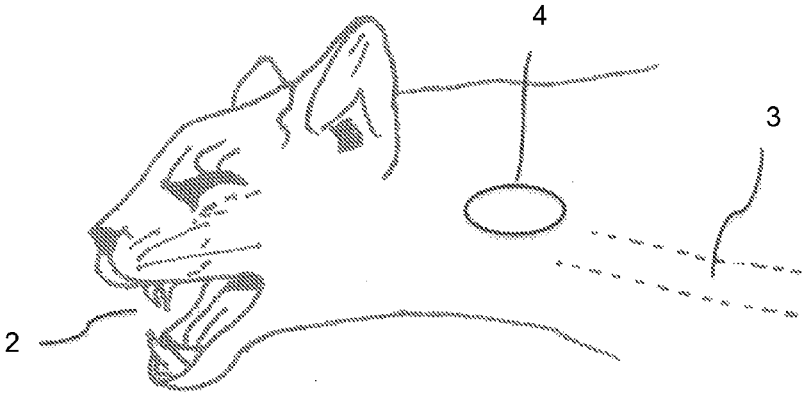
FIG. 4 is a side perspective view of the head and neck of a cat.
Figure 5:
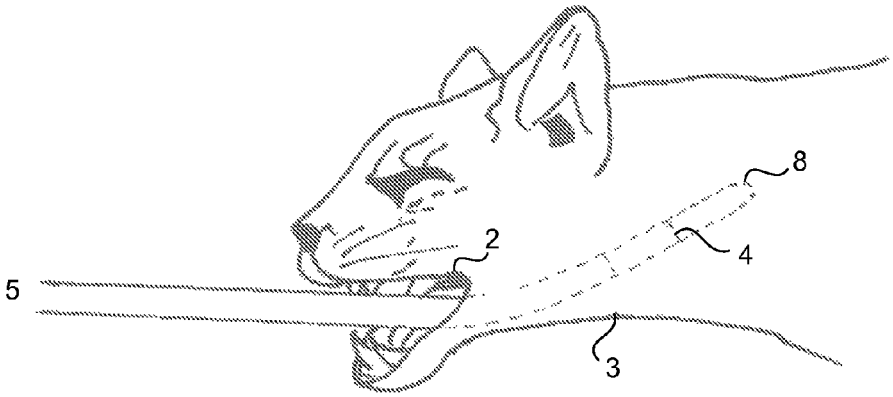
FIGS. 5-11 show a series of drawings of a feeding tube insertion procedure using an exemplary embodiment of a feeding tube placement device disclosed herein.

A description of an exemplary feeding tube insertion process using proposed placement device is as follows:

As shown in FIG. 4, a cat or other small animal has an oral cavity 2, an esophagus 3, and a mid cervical region defined approximately by demarcation 4. In order to insert a feeding tube using the device and method disclosed herein, as shown in FIG. 5, first place the oblique tip 8 of the placement device 5 through the oral cavity 2 and into the esophagus 3 to the level of the mid cervical region 4 (i.e. equal distance between the angle of the mandible and thoracic inlet) and palpate the oblique tip 8 as it bulges the cervical skin.

Figure 6:
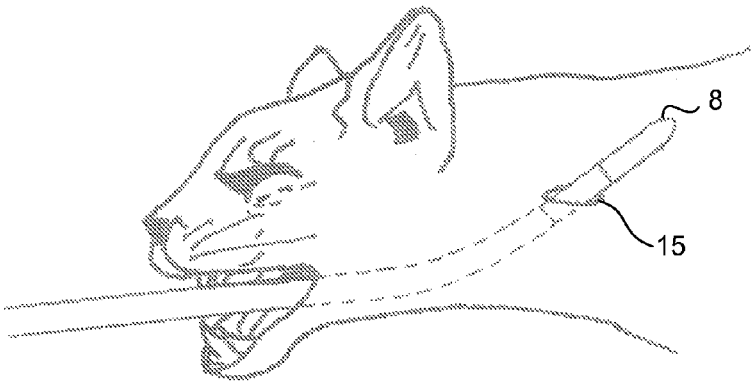

Next, as shown in FIG. 6, make a small incision 15 over the device oblique tip 8. Carefully enlarge the incision in the subcutaneous tissue, cervical musculature and esophageal wall with the tip of a scalpel blade (Ex. #15 blade) to enable penetration of the oblique tip 8 of the placement device 5.

Figure 7:
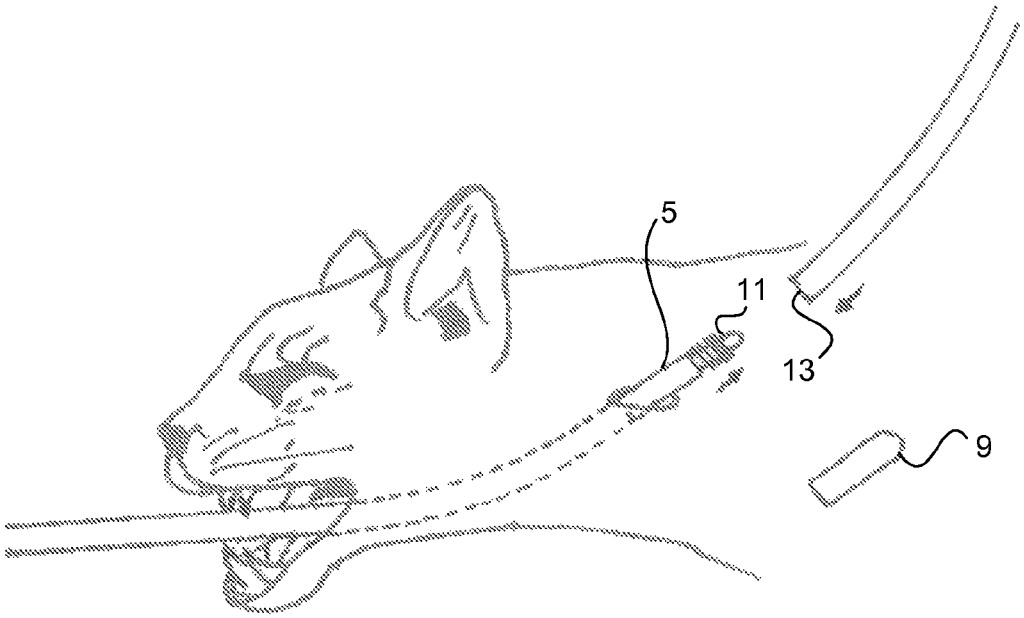

As shown in FIG. 7, remove the removable cap 9 of the placement device 5 and slide the attachment end 13 of the feeding tube 12 onto the functional tip of the device 11, then turn to lock feeding tube attachment end 13 to the placement device 5.

Figure 8:
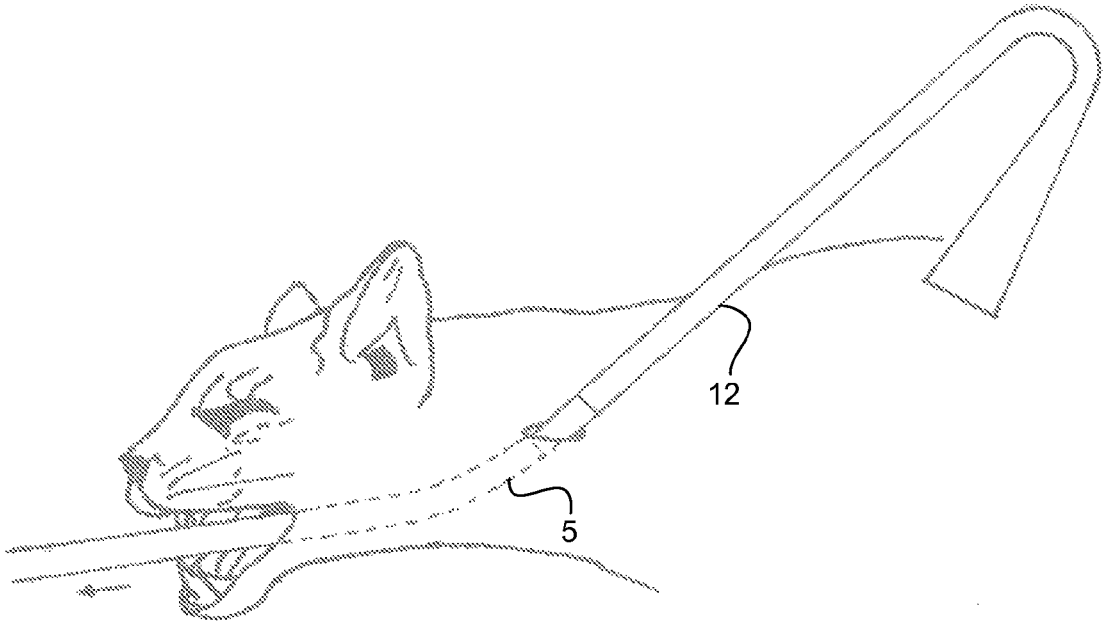

As shown in FIG. 8, retract the placement device 5 and pull the attached feeding tube 12 into the esophageal cavity 3 to an optional predetermined measurement (Ex. 4 cm).

Figure 9:
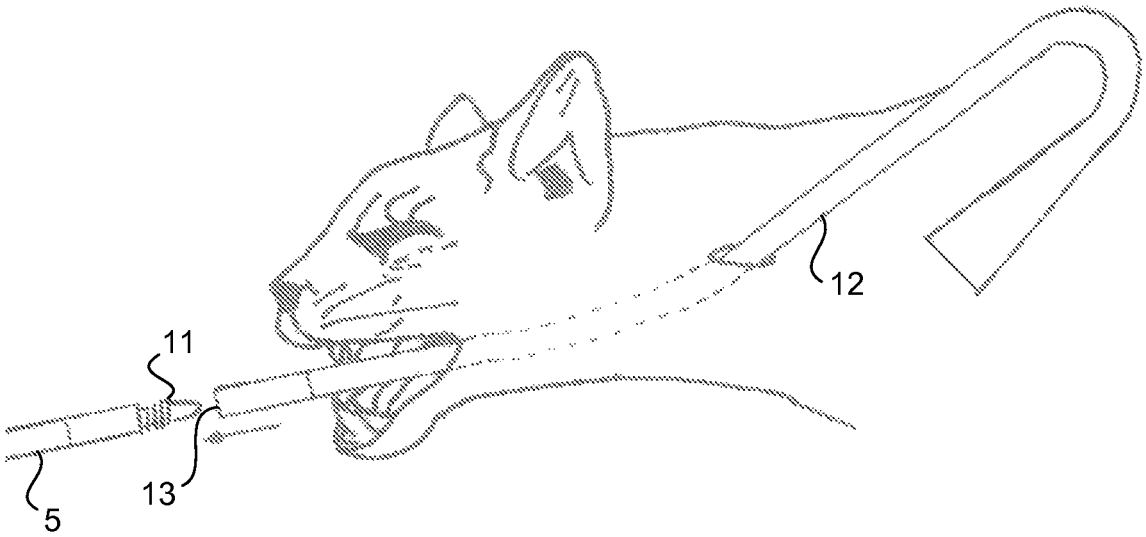

As shown in FIG. 9, then turn the feeding tube 12 in the opposite direction to unlock from the placement device 5. While holding the feeding tube 12 in place, pull the placement device 5 free from the attachment end 13 of the feeding tube and remove device from the oral cavity 2.

Figure 10:
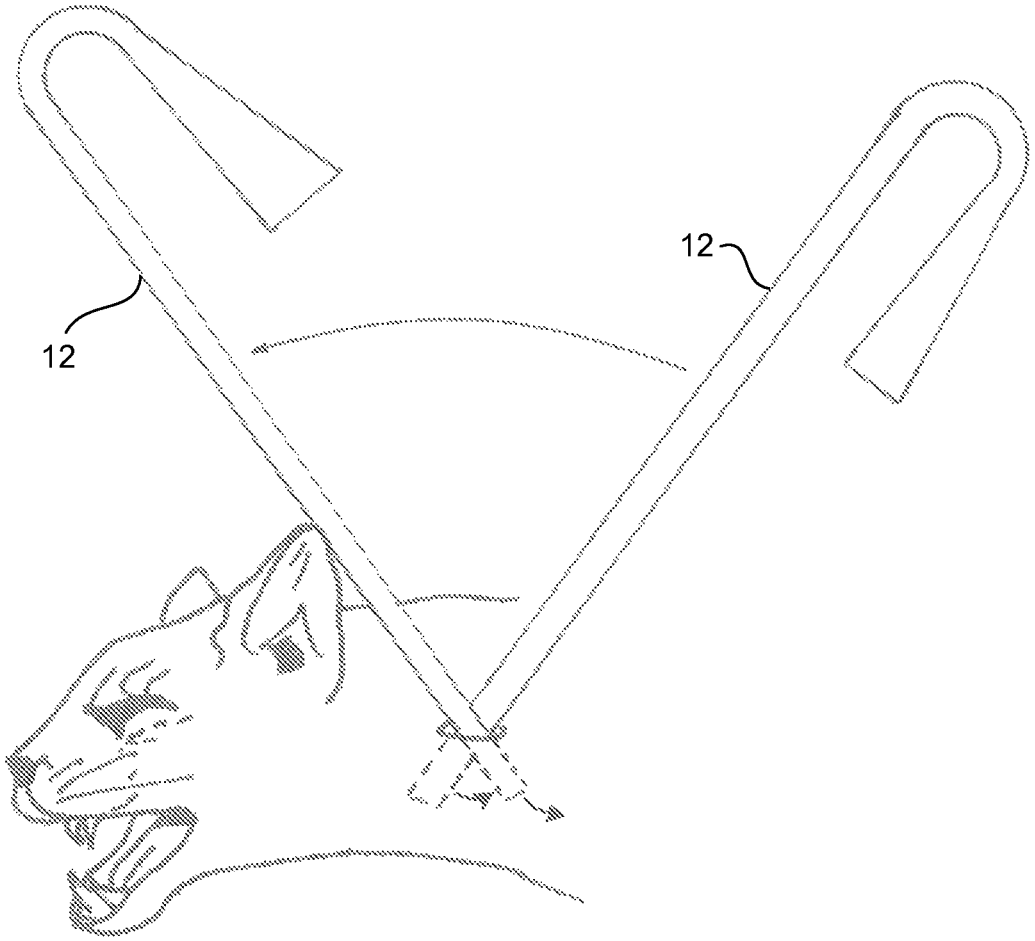

After removing the placement device 5, flip the feeding tube 12 cranially as shown in FIG. 10.

Figure 11:
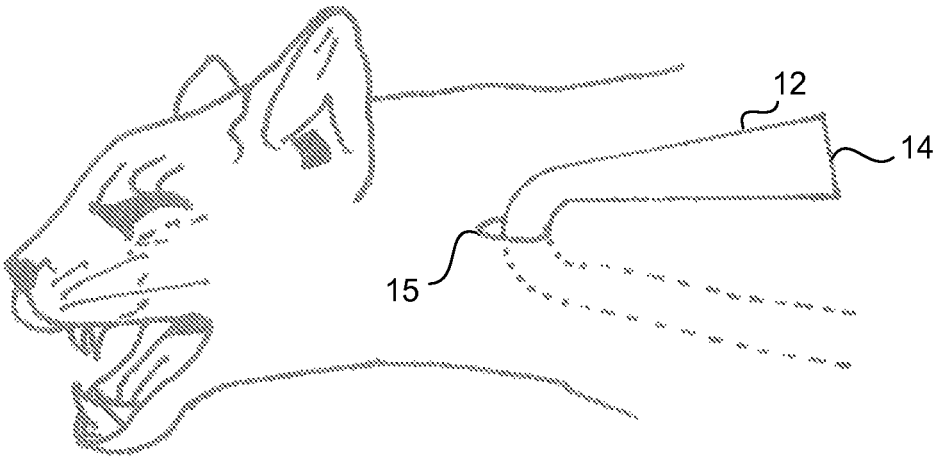

Slide feeding tube attachment end 13 down the esophagus 3 to the premeasured mark so that the feeding end 14 of the feeding tube 12 is optimally placed to commence feeding, as shown in FIG. 11.

The tube can be secured with a Chinese finger-trap suture with or without purse string. The feeding end 14 of the feeding tube 12 can extend from the mid-cervical region 5 incision 15 and the exit point of the feeding tube can be left exposed or bandaged.

The feeding tube 12 is flipped cranially to enable it to slide easily into place down the esophagus 3. The combination of the placement of the bend 10 along the shaft 7 of the placement device 5, and the angle of the bend 10 from the shaft 7, are designed to optimize this step and to ensure the smooth insertion of the feeding tube 12 during the procedure.

The device described herein may be manufactured from a variety of materials, either metal or plastic. As a reusable device, it should be manufactured from a material that can be sterilized according to standard guidelines for sterilization in a healthcare facility. In an exemplary embodiment, the proposed device is manufactured from medical grade aluminum or stainless steel.

One of the novel outcomes of this tool and associated methodology is a greatly reduced time of procedure, reduced use of anesthesia, reduced recovery time, and reduced risk to the animal.

In another example, the device and method described herein could be optimized and scaled for use in a broader segment of animals and procedures.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of insertion of a feeding tube into a patient's esophagus, comprising:

providing a feeding tube insertion device comprising a handle, a shaft, and a functional tip;

inserting said functional tip and a portion of said shaft of said feeding tube insertion device into said patient's mouth and down said patient's esophagus;

creating an incision in said patient's neck and through a wall of said esophagus, pushing said functional tip through said incision, and positioning said functional tip outside of said patient's body;

providing a feeding tube having an attachment end and a feeding end and removably attaching said attachment end of said feeding tube to said functional tip;

withdrawing said device and said attached feeding tube back into said esophagus through said incision; and removing said feeding tube from said functional tip, and removing said device from said patient.

2. The method of claim 1 further comprising the step of repositioning said feeding tube so that said attachment end points toward said patient's stomach instead of toward said patient's mouth.

3. The method of claim 1 wherein said device further comprises a removable cap which encloses said functional tip.

4. The method of claim 3 wherein said attachment end of said feeding tube may be removed from said functional tip by rotating said functional tip within said attachment end.

5. The method of claim 1 wherein said functional tip is threaded and said attachment end of said feeding tube may be removably affixed to said functional tip by rotating said functional tip within said attachment end.

* * * * *